United States Patent [19]

Majors

[11] Patent Number: 4,697,771

[45] Date of Patent: Oct. 6, 1987

[54] REFUSE RECEPTACLE FOR RECEIVING DISPOSABLE REFUSE BAGS

[76] Inventor: Anthony P. Majors, 12807 Cijon St., San Diego, Calif. 92129

[21] Appl. No.: 910,376

[22] Filed: Sep. 22, 1986

[51] Int. Cl.[4] ..... A63B 55/04

[52] U.S. Cl. ..... 248/97; 248/152

[58] Field of Search ..... 248/97, 99, 95, 146, 248/152; 220/404; 141/316, 390, 391; 232/43.1, 43.2; 312/211

[56] References Cited

U.S. PATENT DOCUMENTS

| | | | |
|---|---|---|---|
| 3,186,667 | 6/1965 | Meuer | 248/97 |
| 3,219,402 | 11/1965 | Holman | 312/213 X |
| 3,374,976 | 3/1968 | Kurlander et al. | 248/97 |
| 3,420,483 | 1/1969 | Stalker | 248/95 |
| 3,421,689 | 1/1969 | Reinzan | 248/43.2 |
| 3,522,922 | 8/1970 | Byron et al. | 248/101 |
| 3,595,507 | 7/1971 | Kurlander | 248/97 |
| 3,653,619 | 4/1972 | Plum | 248/99 |
| 3,653,620 | 4/1972 | Benoit | 248/101 |
| 3,664,662 | 5/1972 | Linz | 248/95 |
| 3,893,615 | 7/1975 | Johnson | 248/43.2 |
| 3,905,406 | 9/1975 | Cruse | 248/390 |
| 3,922,046 | 11/1975 | Schneider | 248/211 |
| 3,964,630 | 6/1976 | Getz | 248/63 R |
| 4,037,778 | 7/1977 | Boyle | 248/55 |
| 4,045,103 | 8/1977 | Paolino | 312/213 X |
| 4,062,170 | 12/1977 | Orem | 248/390 |
| 4,196,880 | 4/1980 | Hynes | 248/99 |
| 4,199,122 | 4/1980 | Christie | 248/97 |
| 4,268,081 | 5/1981 | Hawkinson | 248/55 |
| 4,280,676 | 7/1981 | Betts | 248/97 |
| 4,366,916 | 1/1983 | Guido | 248/97 X |
| 4,407,474 | 10/1983 | Swenson | 248/97 |
| 4,437,634 | 3/1984 | Hambleton | 248/97 |
| 4,444,355 | 4/1984 | Cary | 220/404 X |
| 4,487,388 | 12/1984 | Provan | 248/97 |
| 4,558,800 | 12/1985 | Isgar | 248/95 X |

*Primary Examiner*—J. Franklin Foss

*Attorney, Agent, or Firm*—Fulwider, Patton, Rieber, Lee & Utecht

[57] ABSTRACT

A walled refuse receptacle for receiving a paper bag. The side walls include retainer openings into which retainer teeth extend. When the tops of the side panels of a freshly inserted paper bag are pressed lightly outwardly, the side panel tops bend under the teeth. When the tops move past the teeth they bend back and engage the outer surfaces of the teeth, thereby maintaining the bag fully open and in proper position for use. Removal of the bag is the reverse of this procedure. The receptacle side walls project above the other walls to define handle anchorages about which the flexible handles of a plastic bag can be looped to support the plastic bag in open position. The receptacle is thus adapted to handle either paper or plastic bags.

10 Claims, 6 Drawing Figures

FIG. 1
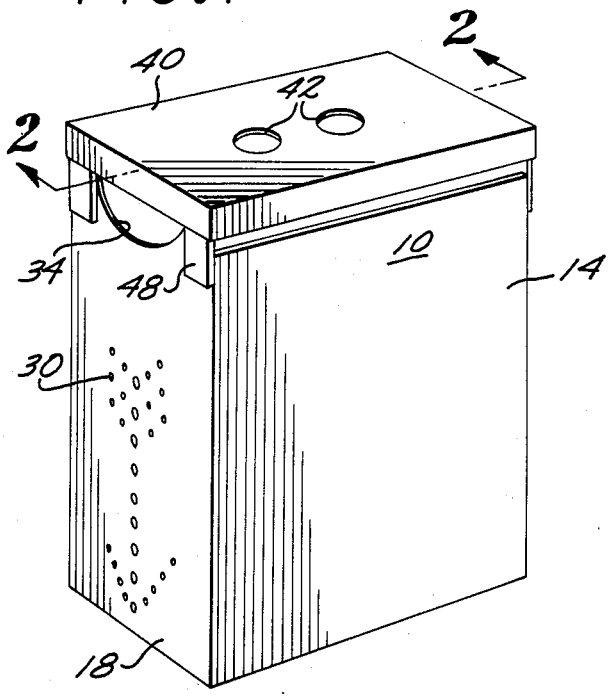
FIG. 3
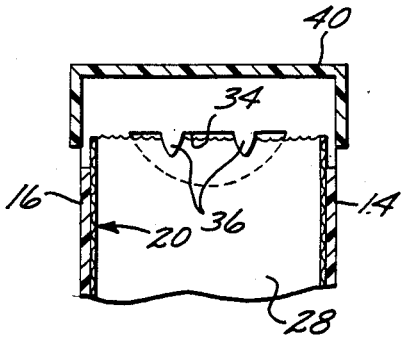
FIG. 4
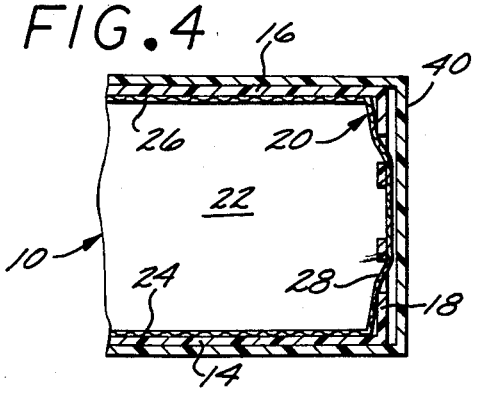
FIG. 2
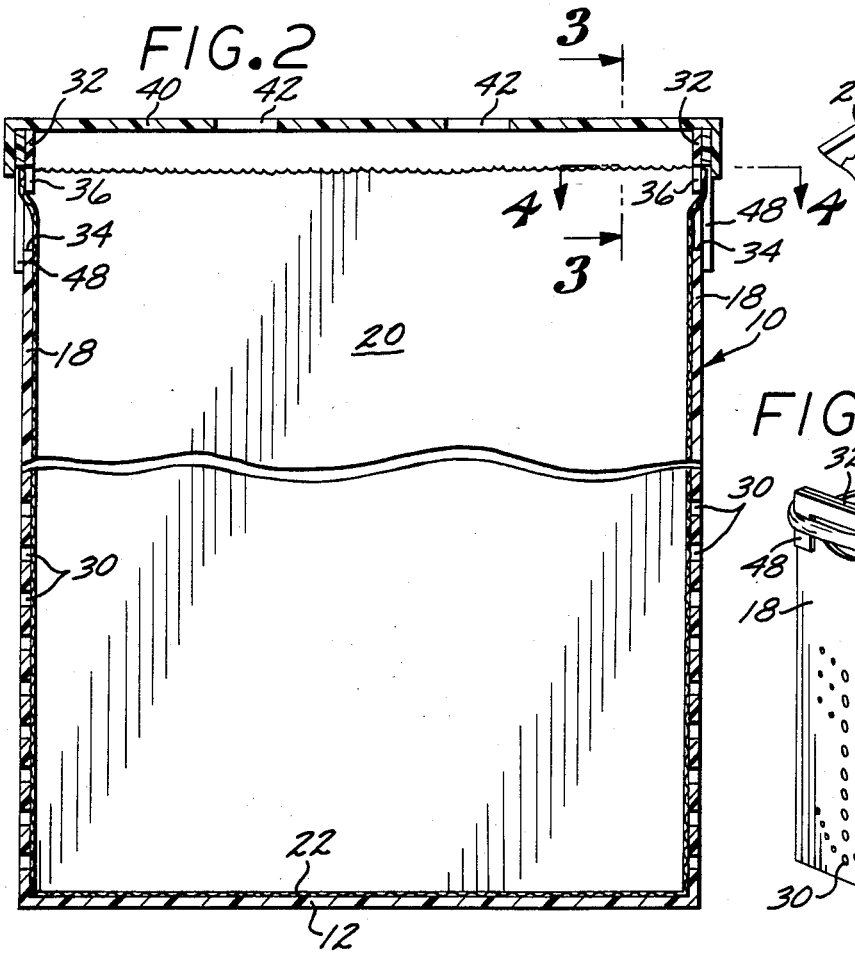
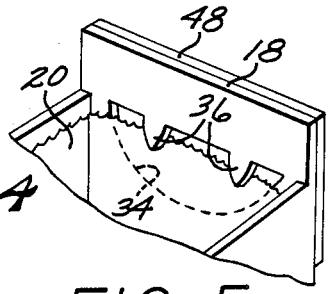
FIG. 5
FIG. 6
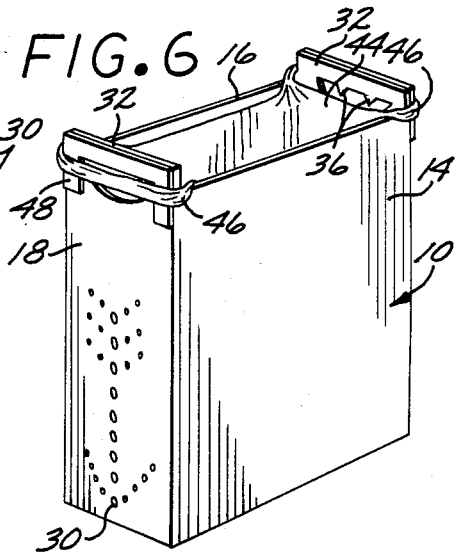

REFUSE RECEPTACLE FOR RECEIVING DISPOSABLE REFUSE BAGS

BACKGROUND OF THE INVENTION

1. Field of the Invention:

The present invention relates to refuse receptacles for receiving diposable, free-standing bags.

2. Description of the Prior Art:

Many householders save their grocery bags for use as receptacle liners for trash and refuse. The grocery bags may be either the traditional heavy brown paper bags or the newer thin, relatively limp plastic bags which have integral handle loops.

Paper grocery bags usually include fold lines to permit them to be folded flat, the fold lines in the bag side panels typically extending vertically to the upper edges of the side panels. These fold lines tend to have a "memory", causing the side panels of a freshly opened bag to move inwardly and partially close the open end of the bag. When a householder wants to place refuse in the bag it is an annoyance to have to reach down and hold the bag open each time a trash item is placed in the bag, at least until the bag is sufficiently full that it stays open.

Various devices have been proposed to prevent the tendency of a foldable paper bag to return to its folded position after being opened. U.S. Pat. No. 3,905,406 discloses a wire frame adapted to fit within a bag to keep it open. Such a stand must be removed in order to dispose of the bag, which is difficult to do without pulling out some of the trash along with the stand. Needless to say the stand also often needs to be cleaned between uses.

U.S. Pat. No. 3,420,483 shows a wire stand which fits on the outside of the bag, but it does not provide any means for holding the bag open.

U.S. Pat. No. 3,274,976 teaches a refuse bag holder having clamps to trap and squeeze the top edges of the paper bag to maintain it open, but the system requires clamps, a cam shaft, a cam, etc., making it relatively complex and costly to manufacture, maintain and keep clean.

The newer thin, plastic grocery bags are too limp to be self supporting and a trash receptacle like that of U.S. Pat. No. 3,420,483 could not be used to hold such a bag. The holders of U.S. Pat. Nos. 4,062,170 and 4,407,474 are capable of supporting thin plastic bags, having side walls which include upward projections or ears about which the handle loops of the plastic bag can be disposed. However, such holders are incapable of handling a traditional paper grocery bag, much less keeping it open during use.

There is a need for a relatively inexpensive refuse receptacle which requires no moving parts and is easy to manufacture, maintain and keep clean, and which is adapted to support in an open position not only traditional paper grocery bags, but also the limp, thin plastic grocery bags which are coming into widespread use.

SUMMARY OF THE INVENTION

According to the present invention, a refuse receptacle is provided which is adapted to receive either traditional paper grocery bags or the more recently introduced limp or thin plastic grocery bags. The receptacle includes a frame having side walls for supporting the side panels of a grocery bag. The side walls include retainer openings which preferably are made sufficiently large to serve as hand openings so that the receptacle can be lifted by the user. The upper margins of the retainer openings include downwardly extending retainers in the form of one or more projections or teeth located at a height to engage the upper edges of most paper bags. The teeth are located at or adjacent the location of the vertical fold lines in the paper bag so that the householder can cause the bag to be retained in the receptacle and held open simply by pushing the side panel upper edges against the retainer teeth to bend or fold over the edges until they pass outwardly of the teeth, at which point the resilience or stiffness of the paper causes the upper edge portions of the bag side panels to become reoriented in a substantially vertical plane for engagement with the outer surfaces of the retainer teeth. This prevents the side panels from folding inwardly and keeps the top of the bag open.

In the case of plastic bags, the side walls of the present refuse receptacle are projected upwardly sufficiently to define a pair of handle anchorages adapted to accept the handle loops of a plastic bag to support it in an opened state.

The refuse receptacle preferably includes vent openings to facilitate bag insertion and removal, a removable top, planar side walls for improved appearance and support of a bag, and a closed bottom for containment of any refuse leakage.

Other objects and advantages of the present invention will become apparent from the following more detailed description taken in conjunction with the accompanying drawings.

BRIEF DESCRIPTION OF THE DRAWINGS

FIG. 1 is a perspective view of a refuse receptacle according to the present invention;

FIG. 2 is an enlarged view taken along the line 2—2 of FIG. 1, the vertical dimension of the figure being reduced to conserve space;

FIG. 3 is an enlarged view taken along the line 3—3 of FIG. 2;

FIG. 4 is an enlarged view taken along the line 4—4 of FIG. 2;

FIG. 5 is a partial perspective view illustrating the manner in which the top of a paper bag side panel is retained within a retainer opening of the receptacle; and FIG. 6 is a perspective view similar to FIG. 1, but illustrating the receptacle cover removed and the receptacle used to receive and support a thin plastic grocery bag.

DESCRIPTION OF THE PREFERRED EMBODIMENT

Referring now to the drawings, and particularly FIGS. 1-4, the refuse receptacle according to the present invention comprises, generally, a body or frame 10 which includes a bottom support or wall 12 of generally rectangular configuration adapted to rest upon a suitable supporting surface.

The bottom wall 12 is integral with vertical front and back supports or walls 14 and 16, and vertical side supports or side walls 18, the walls 14, 16 and 18 defining an upwardly opening, otherwise closed refuse bag receiving space of generally rectangular transverse cross-section adapted to receive a traditional heavy brown paper grocery bag 20. Although there are so-called "shortie" paper grocery bags, most paper grocery bags are of a standard height and the dimensions of the refuse bag receiving space of the present receptacle are made such as to closely receive such standard bags.

The bag 20 is characterized by fold lines (not shown) which permit the bag to be folded flat prior to use. The bag 20 includes a bottom panel 22, a front panel 24, a back panel 26 and side panels 28. These panels are received or engaged by the receptacle walls 12, 14, 16 and 18, respectively, supporting the bag in an upright position during use. Although the frame could be made of wire or other open structure sufficient to support the bag 20, the use of solid walls is preferred for aesthetic reasons, for structural rigidity and for containing any spillage or leakage which may occur from the bag.

The side walls 18 of the receptacle preferably include either random or decoratively oriented vent openings 30 to allow air to escape or enter during insertion and removal, respectively, of the closely received bag. In addition, the side walls 18 extend above the front and back walls 14 and 16 to define raised projections or anchorages 32 which, as best seen in FIG. 6, adapt the receptacle to support plastic bags.

The upper portion of each side wall includes a retainer opening 34 defined by a substantially hemispherical or arcuate lower margin and a generally horizontal upper margin. The openings 34 are preferably large enough to serve as hand holds so that the receptacle can be easily lifted.

The upper margin of each opening 34 defines a pair of transversely spaced apart, depending retainers or downwardly tapered teeth 36, as best seen in FIG. 3. The upper margin of each opening 34 is arranged to be slightly above the upper edge of a bag side panel 28, which places the teeth 36 so that they extend downwardly below the upper edges of the bag side panels 28. Also, the teeth of each pair are located on opposite sides of the vertical center line of the associated side wall 18 so that they straddle the usual vertical fold line of a bag side panel.

When a householer inserts a paper bag 20 into the frame 10, a slight outward tap or pressure against the upper edges or tops of the bag side panels 28 causes the bag side panel upper edges to move between the teeth at the fold lines, and then to bend under the teeth 36 until the edges are past, that is, located outwardly of the teeth 36. The inherent stiffness of the heavy paper material of the usual paper grocery bag then causes the bag upper edges to bend back, resuming their original vertical or unbent state. The teeth 36 thereafter keep the side panels 28 from folding inwardly, and keep the bag fully open.

The bag is easily removed by lightly pushing the tops of the side panels 28 inwardly past the teeth 36, following which the bag can be lifted upwardly out of the receptacle. Such lifting is facilitated by making the receptacle front and back walls 14 and 16 slightly less in height than the side walls 18, allowing the householder to more easily grasp the bag front and back panels 24 and 26.

The receptacle preferably includes an overlying, complemental cover 40 having depending perimetrical walls to fit over the walls of the frame 10. The cover 40 is provided with a pair of finger openings 42 to enable it to be handled easily.

With the foregoing arrangement it is a simple matter for a householder to quickly insert a paper bag 20, and pop the upper portions of the bag side panels 28 outwardly through the retainer openings 34 until the retainer teeth 36 engage the inside upper edges of the bag and hold it open.

The present refuse receptacle is also adapted to accommodate the thin, limp plastic bags also in use by many supermarkets. Such a plastic bag is illustrated at 44 in FIG. 6 and includes a pair of integral, oppositely located loop handles 46 to permit the bag and its contents to be carried. The plastic bag 44 is placed within the frame 10 in the same manner as a paper bag 20, except that the handles 46 are looped about the anchorages 32 to suspend the bag 44 in position. The bag 44 is removed by simply slipping the loop handles 46 off the raised projections or anchorages 32, and lifting the bag upwardly.

The present receptacle is thus capable of handling either type of bag without any need for moving parts, clamps, cam devices, etc. to hold the bags in position. If the receptacle is made of light gage material, the anchorages 32 can be reinforced by attaching inverted U-shape plates 48 across the tops of the side walls 18.

Various modifications and changes may be made with regard to the foregoing detailed description without departing from the spirit of the invention.

I claim:

1. A refuse receptacle for receiving a paper bag having a bottom panel and free standing front, back and side panels which define an upwardly open refuse receiving refuse space of generally rectangular horizontal cross section, each of the upper edges of the side panels being characterized by vertical fold lines which tend to bias such upper edges inwardly to partially close the open end of the bag, said refuse receptacle comprising:

bottom support means for supporting the bottom panel of the bag;

front and back support means for supporting the front and back panels of the bag; and a pair of side support means for supporting the side panels of the bag, said bottom, front, back and side support means defining an upwardly opening refuse bag receiving space, said side support means including retainer openings, respectively, having upper margins characterized by depending, immovable retainer means extending downwardly into said retainer openings, said retainer means being dimensioned so as to engage the upper edges of the bag side panels whereby upon pressing the side panels outwardly, the side panel upper edges are bent over by said retainer means until such edges are located outwardly of said retainer means, said retainer means being adapted to engage such edges in such location after such edges bend back to their original unbent state, thereby retaining such edges outwardly of said retainer means.

2. A refuse receptacle according to claim 1 wherein said retainer openings are made sufficiently large to constitute hand openings for lifting said receptacle.

3. A refuse receptacle according to claim 1 wherein each of said retainer means comprises a pair of spaced apart, depending retainer teeth located on opposite sides of the vertical center line of the associated one of said side support means.

4. A refuse receptacle according to claim 1 wherein said pair of said support means to support said cover and extend above said front and back support means to define plastic bag handle anchorages adapted to accept the opposite loop-like flexible handles of a plastic bag to support the plastic bag within said refuse bag receiving space.

5. A refuse receptacle according to claim 1 and including a cover for engaging the upper extremities of said side support means to overlie said refuse bag receiving space.

6. A refuse receptacle for receiving a paper bag having a bottom panel and free standing front, back and side panels defining an upwardly open refuse-receiving space, and wherein the side panels include vertical fold lines, said refuse receptacle comprising:

frame means including a pair of side walls for supporting the side panels of the bag, said side walls defining the sides of an upwardly opening refuse bag receiving space, each of said side walls including a retainer opening having an upper margin configured to define a pair of retainer teeth spaced apart on opposite sides of the vertical center line of the associated side wall, said teeth extending downwardly into said retainer openings, said retainer teeth being dimensioned so as to allow the upper edge of a bag side panel to pass between them, and then to engage and bend over such edge to permit passage of such edge beneath and then outwardly of said retainer teeth, said retainer teeth being adapted to engage such edge after it bends back to its original unbent state, thereby retaining such edge outwardly of said retainer teeth.

7. A refuse receptacle according to claim 6 wherein the upper extremities of said pair of side walls define plastic bag handle anchorages adapted to accept the opposite loop-like flexible handles of a plastic bag to support the plastic bag within said refuse bag receiving space.

8. A refuse receptacle according to claim 6 wherein said retainer openings are made sufficiently large to constitute hand openings for lifting said receptacle.

9. A refuse receptacle according to claim 7 and including front and back walls for supporting the front and back panels of the bag, said front and back walls being of a height less than the front and back panels of the bag to facilitate grasping of the bag during insertion and removal of the bag.

10. A refuse receptacle according to claim 6 wherein each of said teeth is downwardly tapered to define a relatively wide base and a relatively narrow end whereby passage of the upper edge of a bag side panel between and outwardly of said teeth is facilitated.

* * * * *

UNITED STATES PATENT AND TRADEMARK OFFICE

CERTIFICATE OF CORRECTION

PATENT NO. : 4,697,771

DATED : October 6, 1987

INVENTOR(S) : Anthony P. Majors

It is certified that error appears in the above-identified patent and that said Letters Patent is hereby corrected as shown below:

Claim 4, line 2, delete "said" (second instance), and insert --side--;
lines 2 and 3, delete "to support said cover and"; and
line 3, after "means" insert --to support said cover and--.

Signed and Sealed this

Seventh Day of June, 1988

*Attest:*

DONALD J. QUIGG

*Attesting Officer*

*Commissioner of Patents and Trademarks*